United States Patent [19]

Kennon

[11] 4,155,576

[45] May 22, 1979

[54] DOOR KEEPER

[76] Inventor: William O. Kennon, Rte. 3, Box 263-B, Moscow, Id. 83843

[21] Appl. No.: 890,041

[22] Filed: Mar. 27, 1978

[51] Int. Cl.[2] ..... E05C 19/16

[52] U.S. Cl. ..... 292/251.5; 16/82; 49/394; 292/75

[58] Field of Search ..... 16/82, 83, 85, DIG. 20, 16/48.5, DIG. 14; 292/75, 251.5; 49/394, 171

[56] References Cited

U.S. PATENT DOCUMENTS

| | | | |
|---|---|---|---|
| 2,970,857 | 2/1961 | Squire | 292/251.5 |
| 3,400,964 | 9/1968 | Baermann | 292/251.5 |
| 3,934,909 | 1/1976 | Van Natter | 292/251.5 |
| 4,047,331 | 9/1977 | Davlantes | 49/171 |

*Primary Examiner*—Werner H. Schroeder
*Assistant Examiner*—Moshe I. Cohen
*Attorney, Agent, or Firm*—Wells, St. John & Roberts

[57] ABSTRACT

A door keeper for double swing doors that retains the doors against partially opening due to wind forces. The keeper includes a permanent magnet that is mountable to a door frame. The magnet includes a flat surface that may be positioned flush with the adjacent surface of the door frame. A roller formed of magnetic material is mounted on brackets to the door in close proximity to the magnet when the door is in a closed position. Brackets mount the roller for free rotational movement about its axis and limited transverse movement toward and away from the permanent magnet surface. Therefore, when the door is in a closed position, the roller is engaged with the magnet by magnetic attraction, which retains the door in a closed condition against reasonable wind force. However, the roller is capable of rolling over the magnet surfaces when the door is subsequently moved by someone wishing to leave or enter the associated building.

3 Claims, 3 Drawing Figures

DOOR KEEPER

BACKGROUND OF THE INVENTION

The problem peculiar to use of double swing doors is that in windy weather the doors are often blown slightly ajar and remain that way until the wind stops. This, of course, is undesirable, especially in wet or cold weather. Usually, such doors cannot include an effective latching mechanism since they are designed to move freely about their hinge axes either inwardly toward the inside of the building or outwardly away from the building. Usually, such doors have a closer built into them which biases the door or doors to a center closed position within the door frame. However, a small constant force exerted on the door, such as that caused by wind, will often overcome the biasing mechanism and cause the door to be partially opened. It is therefore desirable to obtain some form of mechanism by which greater force is initially required to move the door from the closed condition.

DETAILED DESCRIPTION OF A PREFERRED EMBODIMENT

Figure 1:
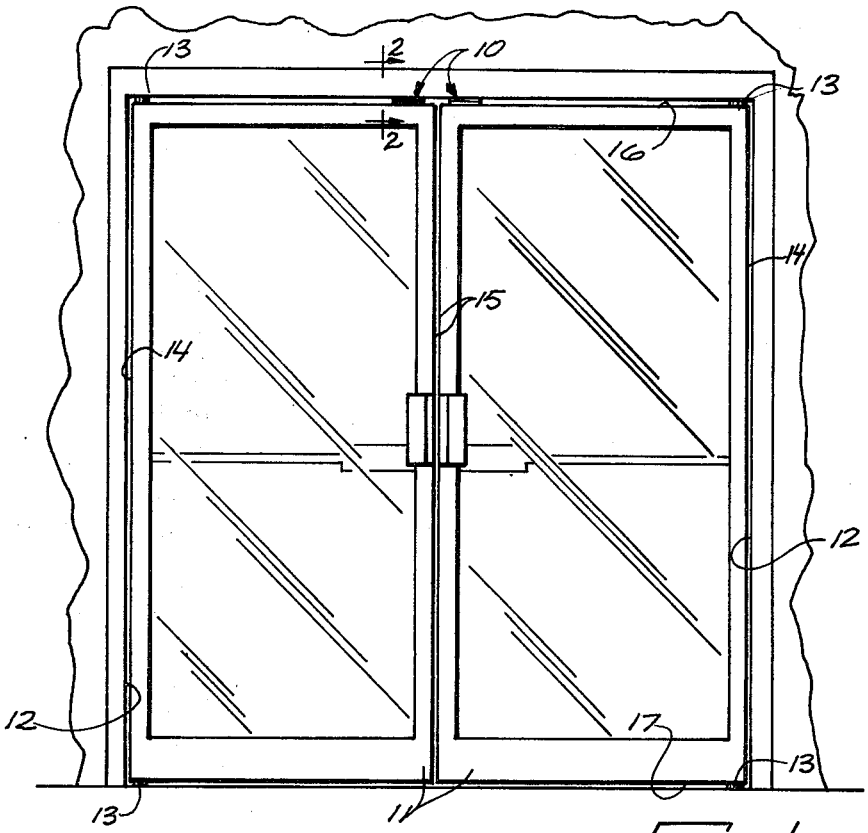
FIG. 1 is a fragmentary frontal view showing a pair of double swing doors incorporating the present invention.

The door keeper of the present invention is illustrated in the accompanying drawings and is generally designated therein by the reference character 10. It is intended that the keeper be utilized with double swing doors such as those illustrated in 11. They can be a single door installation, or one including double doors as shown. Such doors 11 are mounted within stationary door frames 12 and pivot both inwardly and outwardly about the axes of hinges 13. These hinges 13 are typically located adjacent a inward side edge 14 of the door and support the door for movement relative to frame 12.

For purposes of description, the doors 11 are shown to have an outward side edge 15 that is parallel to and opposite the inward side edge 14. Also, there is included a top horizontal edge 16 and a parallel bottom horizontal edge 17 that interconnect the side edges 14 and 15.

Figure 2:
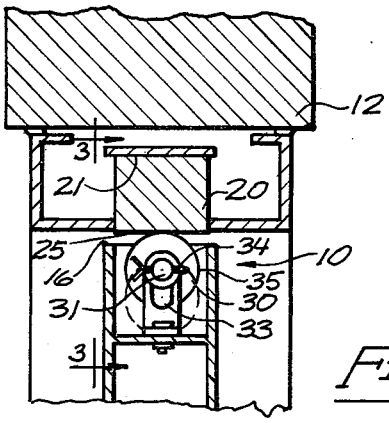
FIG. 2 is an enlarged sectional view taken along line 2—2 in FIG. 1.
Figure 3:
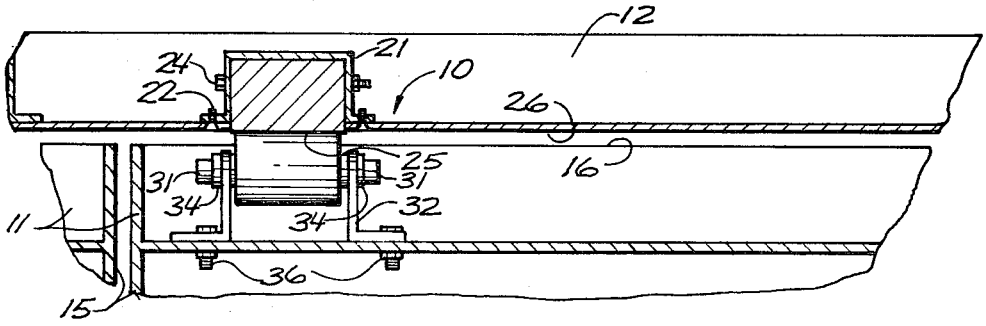
FIG. 3 is a sectional view taken along line 3—3 in FIG. 2.

The elements comprising the present invention may best be understood with reference to FIGS. 2 and 3. They comprise a magnet member 20 and a roller member 30 that are adapted to be mounted to the door frame and to the door respectively. Magnet member 20 is mounted to the door frame in a stationary relation to the door by a first bracket 21. Screws 22 mount the bracket 21 and magnet 20 to the door frame 12. A bolt and nut assembly 24 is provided to secure magnet member 20 to the bracket 21. Magnet 20 includes a flat exposed surface 25 that may be positioned by the screws 22 to become flush with the adjacent surface 26 of door frame 12. This assures that the original clearance provided for door 11 within frame 12 will remain unobstructed.

The roller member 30 is formed of a magnetic material and is carried by a second bracket 32 for free rotation about an axis that lies within a plane perpendicular to the hinge axis. Roller 30 includes stub shafts 31 at its opposite ends that are movably received by bracket 32. The bracket 32 includes slots 33 that receive the stub shafts 31 to allow free rotation of the roller 30 about its axis and also to enable movement of the roller toward or away from the magnet member in a direction transverse to the roller axis. The alternate positions of the roller are shown in FIG. 2 in dashed and solid lines. Stub shafts 31 are fitted with collars 34 and fastened by cotter pins35 to the stub shaft ends outward of the slotted portion of the brackets. This permits free rotational movement of the roller member 30, but prevents longitudinal movement of the roller within the bracket boundaries.

Fasteners 36 are provided to mount the bracket means 32 to the door 11. The particular location of the bracket means 32 and magnet member 20 as illustrated are preferred. However, it is understood that a similar purpose may be achieved by mounting the roller within the door threshold and securing the magnet to the door bottom horizontal edge 17. The upper location is preferred since it removes the roller and magnet from tread wear and the usual soil and dampness present about the lower portion of exterior double swing doors.

It is particularly desirable to locate the magnet member 20 and bracket means 32 toward the outward side edge 15 of the door. By doing so, greater effect is produced to hold the door in the closed position against the continuous pressure of winds. In fact, in a single double swing door arrangement, the magnet could be mounted to the door frame along the vertical frame surface facing the outward side edge 15 and the roller 30 would then correspondingly be positioned on the outward side edge of the door such that its swing path would pass by the magnet.

It will be noted in FIG. 2 that the positioning of the roller member and magnet member is such that when the door is in a closed condition, the magnet and roller member are engaged. However, since the roller member will roll freely except for the magnetic force, the desired effect is achieved by requiring slightly more force than ordinary to initially move the door toward an open condition. As this happens, the roller 30 will roll over the surface 25 of the magnet until it passes from the field of force. At that time, the roller will drop to the dotted line position so as not to interfere with further swinging movement of the door.

Similarly, when the door is returning to the closed position, the initial approach by the roller will be in the lower dashed position until the roller comes within the field of attraction for the magnet. It will then be pulled upwardly to engage the surface of the magnet and will be held within the magnetic field until sufficient force has been applied to overcome that attraction.

It can be easily understood from the above description that the present door keeper will function to maintain a door in a closed position against wind forces from either side of the door. It is also understood that the keeper in no way interferes with or causes any obstruction to the door passageway or clearance between the door and frame, because the magnet is mounted flush with the frame and, when the roller is not in use, it will fall back into the recess of the door.

The above description was set forth merely to describe a preferred form of the present invention and is not in any way intended to restrict the scope of my invention. Therefore, only the following claims are to be taken as definitions of what I claim to be my invention.

What I claim is:

1. A door keeper for double swing doors that are hinged to a door frame for pivotal movement about an upright hinge axis at an inward side edge thereof, said keeper comprising:

a magnet member;

first bracket means on the magnet member for fixing the location of the magnet member;

a roller member formed of magnetic material;

second bracket means mounting the roller member for free rotational movement about its axis and for restricted movement in a direction transverse to its axis;

wherein one of said bracket means is adapted to be fixed to a door frame adjacent an outward side edge of an associated door and the other bracket means is adapted to be mounted to the door at a location thereon such that when the door is in a closed position, the magnet member and roller member magnetically engage one another to releasably retain the door in the closed position.

2. The door keeper as set out by claim 1 wherein said first bracket means is mountable to the door frame upwardly adjacent to a top horizontal edge of the associated door, and said second bracket means is mountable to the door on its top horizontal edge.

3. The door keeper as set out by claim 1 wherein the magnet member is a permanent magnet;

said first bracket means including elements for mounting the permanent magnet to a door frame with an exposed flat surface of the permanent magnet member being flush with an adjacent surface of the door frame.

* * * * *